US005125634A

United States Patent [19]

Lawrence

[11] Patent Number: 5,125,634

[45] Date of Patent: Jun. 30, 1992

[54] COMBINED SHEET COLLATOR AND STAPLER

[75] Inventor: Frederick J. Lawrence, Tustin, Calif.

[73] Assignee: Gradco (Japan) Ltd., Tokyo, Japan

[21] Appl. No.: 730,746

[22] Filed: Jul. 16, 1991

[51] Int. Cl.[5] ..... B42B 1/02

[52] U.S. Cl. ..... 270/53; 270/52

[58] Field of Search ..... 270/37, 53, 58, 52

[56] References Cited

U.S. PATENT DOCUMENTS

| | | | |
|---|---|---|---|
| 4,361,393 | 11/1982 | Noto | 270/53 |
| 4,566,782 | 1/1986 | Britt | 270/53 |
| 4,946,152 | 8/1990 | Ishikawa | 270/53 |
| 4,971,302 | 11/1990 | Morii | 270/53 |
| 5,024,430 | 1/1991 | Seki | 270/53 |

FOREIGN PATENT DOCUMENTS

| | | | |
|---|---|---|---|
| 281258 | 11/1989 | Japan | 270/53 |

*Primary Examiner*—Edward K. Look
*Assistant Examiner*—Therese M. Newholm
*Attorney, Agent, or Firm*—Newton H. Lee, Jr.

[57] ABSTRACT

A sheet sorter for a copy producing machine has trays which are sequentially moved past a sheet entry location by a tray shifting device. Sheets are fed into the trays to form collated sets. A gripper is moved from a retracted position into a position at the trailing edge of the sheets to grip a set of sheets during stapling operations and partially remove the set of sheets from the tray and move the set into the throat of a stapler. After stapling, the gripper returns the stapled set to the same tray and releases it. Alternative forms of devices are disclosed for opening the trays to receive sheets from an infeed and for affording space for the gripping means to move between adjacent trays in a space between trays provided by the tray shifting cams.

7 Claims, 5 Drawing Sheets

Fig. 11
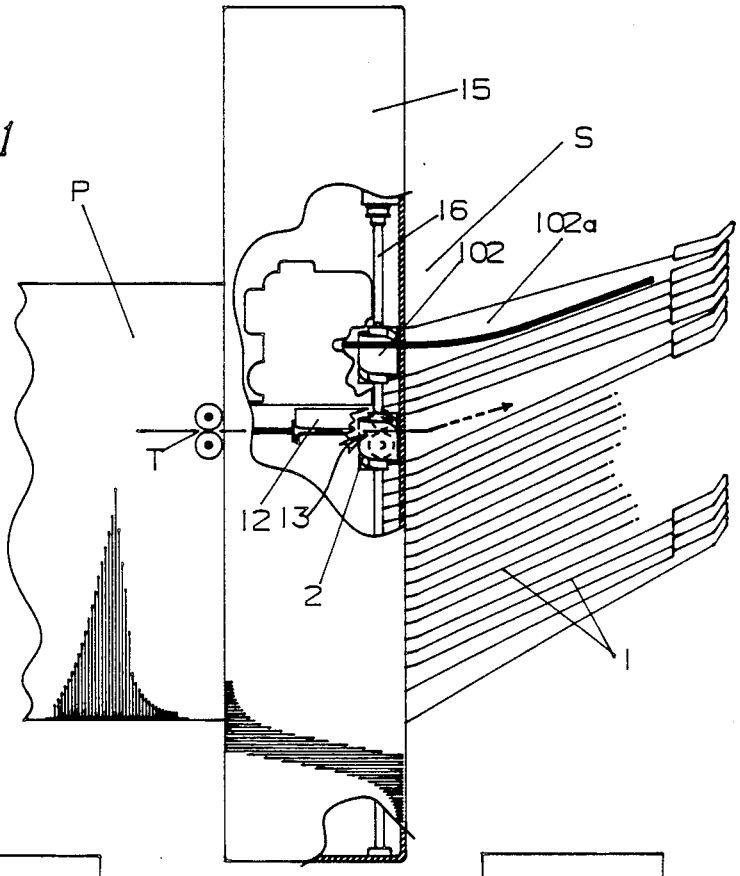
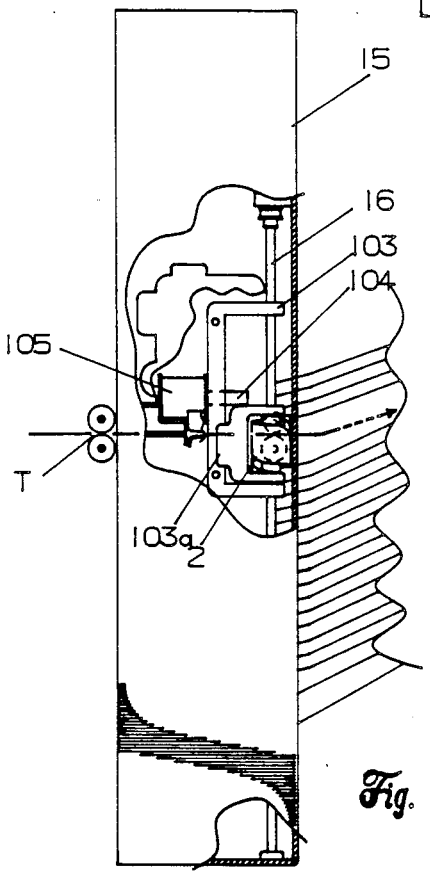
Fig. 12a
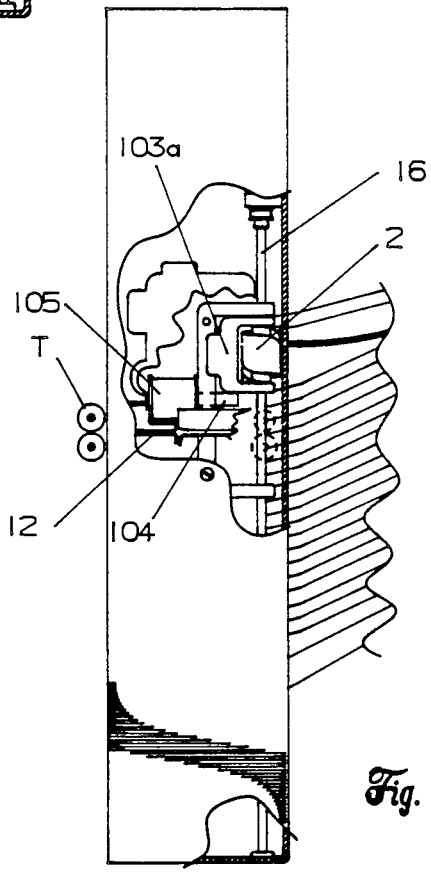
Fig. 12b

COMBINED SHEET COLLATOR AND STAPLER

BACKGROUND OF THE INVENTION

Collators have evolved for use with automatic sheet reproducing machines, wherein the collated set of sheets are stapled or finished in the collator trays.

The problems of stapling in combination with collating sets of sheets differ, depending upon the nature of the collator. For example, when the collating trays are disposed in fixed stacks, spaced vertically to receive a selected number of sheets in sets in the trays, it is a relatively simple task to mechanically remove sets of sheets from the trays and transport the sheets to a stapling station or finishing station or to move the trays from a sheet receiving position to a sheet stapling or finishing position at which the sets are bound.

In recent years, collating or sheet sorting machines have been developed for use in conjunction with reproducing machines i.e., photocopying, or printing machines, wherein the collators or sorters are of a compact configuration, having trays which are mounted so as to be shifted from positions above and below a sheet entry location at which sheets are fed from the reproducing machine, or at the discharge location of a sheet transport, at which the trays are spaced relatively far apart to facilitate entry of a desired number of sheets. At the positions above and below the sheet entry location, the trays may be close together and can compact the sheets into a reasonably tight set.

These moving bin sorters or collators provide limited space for the purpose of installing a stapler and the closely spaced relationship of the trays, in all but the sheet receiving position renders difficult application to the structure of an automatic stapler for in-tray stapling of the sets.

Prior devices have been developed, however, for in-tray stapling of collated sets, in a number of ways. Typical moving tray sorters have the trays extended upwardly on an incline in the direction of sheet movement into the trays and the trays are actuated by a suitable cam to vertically move the ends of the trays proximate the sheet entry from below the sheet entry to above the sheet entry.

U.S. Pat. No. 4,928,941, granted May 29, 1991, to Nobutaka Uto, et al discloses one example of a sorter combined with a stapler which is moved from a position out of the path of sheets entering a tray to position at which the anvil of the stapler is moved to a position below the set of sheets and the stapler body occupies space caused by the inherent longitudinal displacement of the trays above the sheet receiving tray, as the inclined tray moves from below to above the sheet entry location. The longitudinal displacement of the superposed trays provides space for the stapler body, even through the trays are not sufficiently vertically spaced to provide space for the stapler body.

U.S. Pat. Nos. 4,687,191, granted Aug. 18, 1987, to Stemmle and 4,681,310, granted Jul. 21, 1987 to Cooper, disclose moving tray sorters of the type wherein the trays are spaced apart to receive sheets and are close together above and below the sheet entry location. In these prior devices, the tray shifting or indexing means are constructed to cause the trays to provide a space or spaces in addition to the normal sheet receiving spacing of the trays, whereby the stapler may be moved from a position clearing the paper path at the sheet inlet to a position at which the anvil and body of the stapler are accommodated by the additional spaces between trays.

On the other hand, the need for providing space for the stapler may be obviated in the case that the tray may be shifted to the stapler. As indicated above, the mode of operation can be accomplished simply in vertically spaced and fixed trays which can be translated horizontally to or from a stapler. Also, it is known to use certain tray shifting mechanisms, including guides which direct the course of the tray ends proximate the sheet inlet location, so that the trays are moved horizontally opposite to the direction of sheet travel into the stapler throat between the anvil and the body of a fixed stapler which is not restrained in its application to a set of sheets by the path of sheets into the trays during normal sorting or collating of the sheets.

In all of these set stapling or binding operations, there is a problem of stapling efficiency if the set of sheets is not in a compact and neat order during staple penetration when the stapler is activated. Transfer devices which grip the set of sheets, transfer the set to an out of the way stapler and return the stapled sets to the tray or deposit the sets in a receptacle are quite efficient due to the clamping action of the transfer device on the sets. Such a finisher is shown in Noto U.S. Pat. No. 4,361,393. However, such machines, usually referred to as finishers, either in association with a collator on a reproduction machine or used for off-line collating, are large and expensive, and do not lend themselves to advantageous use in conjunction with typical, small compact sorters used in combination with photocopying machines, such as the sorter disclosed in my U.S. Pat. No. 4,911,424, granted Apr. 13, 1985, or other compact sorters such as that shown in my prior U.S. Pat. No. 4,343,463, granted Aug. 10, 1982, as examples of such sorters, with which the present invention is concerned.

Stapling devices which are mounted at one side of the trays of the sorter are also known, as disclosed in Morii et al, U.S. Pat. No. 4,971,302, but such a construction results in increased overall width of the machine and hinders access to the stapled sets or unstapled copies at the stapling side of the sorter.

SUMMARY OF THE INVENTION

With the foregoing in mind, the present invention relates to the combination of a moving tray sorter, as described above, at the sheet inlet location, with a stapler, wherein a gripper engages and partially removes sets of sheets from a tray when that tray is spaced from the tray above as in the case of receiving sheets from a copier or printer, and an edge of the respective sets is moved into the throat of a stapler where the set is stapled, and then the stapled set is returned to the tray. Following stapling of all sets of sheets, they remain in the collator trays for removal in the usual manner, as in the case of in-tray stapling.

More particularly, the invention contemplates a stapler mounted adjacent to a sheet infeed assembly which carries sheets from the output of the copier or printer to the trays as they are respectively positioned to receive sheets from the infeed, and wherein a sheet gripping mechanism grips sets and is operated to partially remove the gripped set from the tray, carry the set to the stapler and, then, return the stapled set to the tray.

This may be accomplished, as more fully described hereinafter, by mounting the stapler and gripper mechanisms on a vertically movable support which also supports the sheet infeed mechanism, wherein, a) during normal sorting operation the support is vertically positioned so that the infeed mechanism receives sheets from the copier or printer exit and transports the sheets to the trays as they are vertically shifted at their inlet ends between the closely spaced positions above and below the infeed and spaced apart at the infeed to receive a set of sheets of an appropriate number of sheets, and b) for the stapling operation the support is shifted vertically to position the gripper and stapler mechanisms at the location previously occupied by the infeed, so that the gripper mechanism is operative to partially remove sets from the trays in the same vertical position in which the trays received the sheets. Such a construction enables application of the inventive concept of sorters embodying the subject matter of my prior patent, U.S. Pat. No. 4,911,424 with a minimum of modifications.

Alternatively, the tray shifting mechanism may be constructed to cause the trays at their inlet ends to be opened at a first vertical position during sorting and at a second vertical position during stapling operations. In that case, the tray shifting and lifting mechanisms as described in my prior U.S. Pat. No. 4,911,424 would be modified to provide the adequate space for partial set removal from the trays at the stapling position, but, otherwise, such mechanism may be the same as described therein.

The present invention also contemplates, as an additional feature, a structure wherein a tray liner is employed at the sheet inlet end and is vertically shifted to a position at which the sets are gripped and then lowered to facilitate partial removal of the set from the tray. This arrangement also enables the sheet receiving ends of the trays to be more rigid because there is no need for removing structural portions of the tray to permit gripping of the sets by the gripping mechanism. This is significant in that the sheet inlet ends of the tray are provided with the parts which coengage with the tray shifting cams and support the weight of the trays and the paper in the trays.

This invention has other features and advantages which will be hereinafter described and be more readily understood with reference to the accompanying drawings, forming a part hereof, and illustrating the concepts of the invention as embodied in its preferred forms.

In the drawings:

FIG. 11 is a view illustrating in side elevation, with the housing broken away, a modified form of the invention;

FIG. **12*a* is another view illustrating in side elevation, with the housing broken away, a further modified form of the invention with the sorter in a sheet receiving, collating mode of operation; and FIG. 12*b* is a view like FIG. 12*a***, but showing the sorter in the stapling mode of operation.

Figure 1:
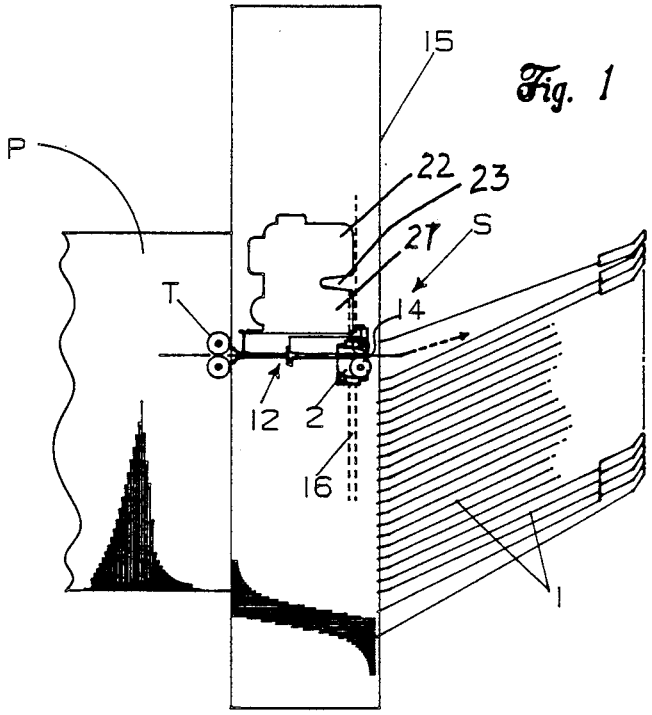
FIG. 1 is a side elevation generally illustrating the collator of the invention combined with a machine for producing copies and feeding the sheets of paper to the collator.
Figure 2:
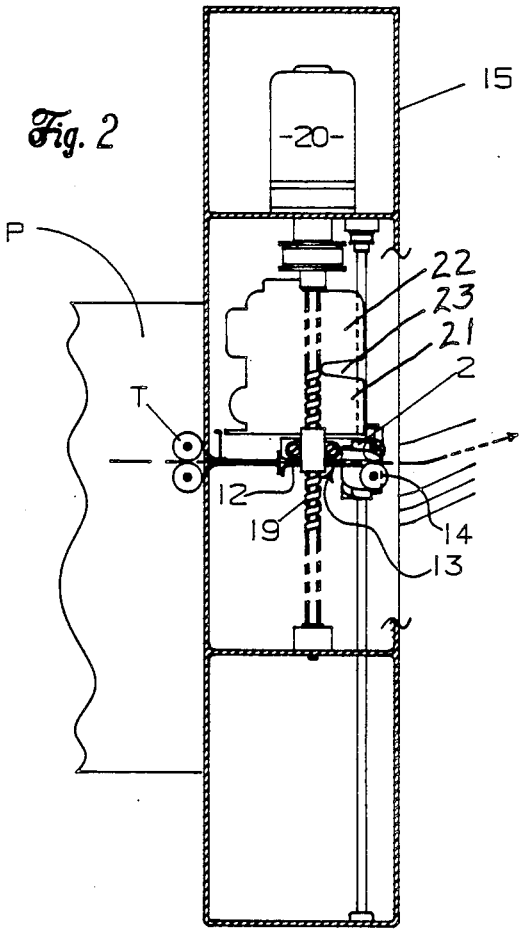
FIG. 2 is an enlarged view partly in vertical section showing the combined apparatus in a condition for feeding sheets from the reproducing machine to the collator, and with the set gripping and stapling mechanism in an inoperative position.
Figure 3:
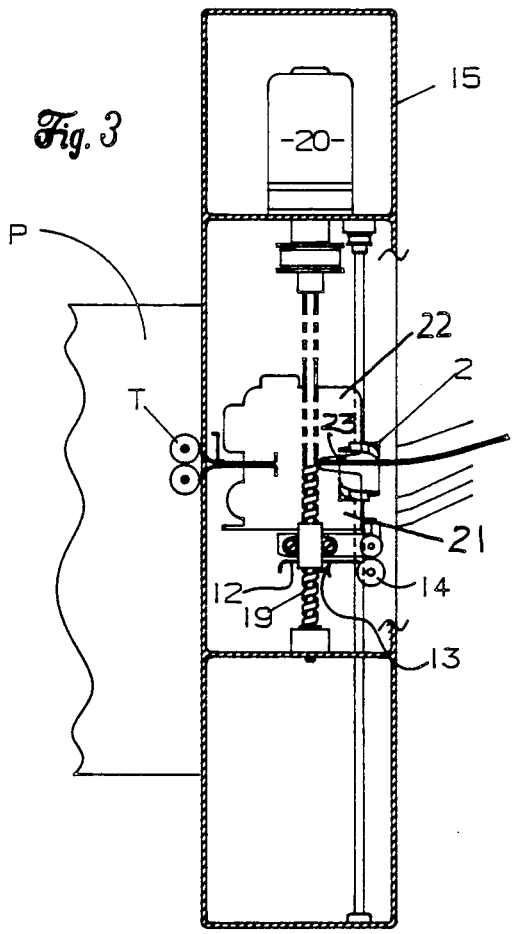
FIG. 3 is a view corresponding to FIG. 2, but showing the gripping and stapling mechanism in an operative position.
Figure 4:
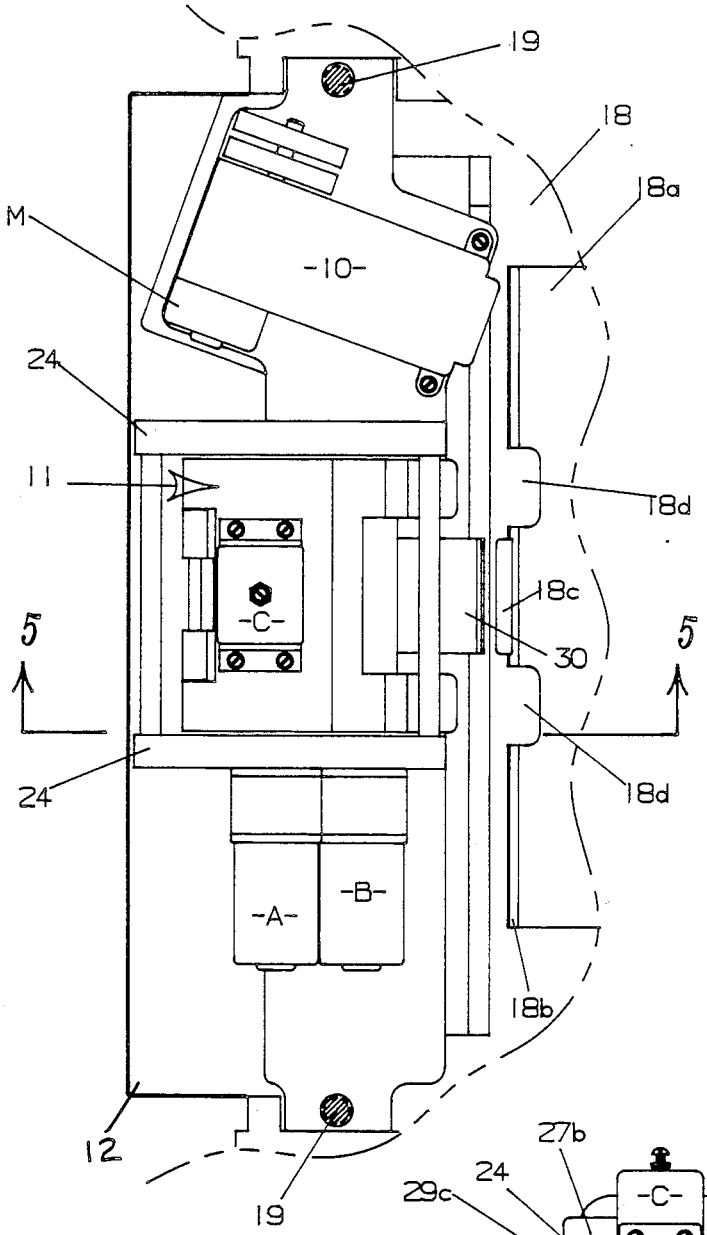
FIG. 4 is a fragmentary plan view as taken on the line 4—4 of FIG. 2.

As seen in the drawings referring first to FIGS. 1 through 3, there is shown a machine P for printing successive sheets, such as a photocopier adapted to reproduce originals in a selected number and feed the same by transport rolls T to a receiver or sorter S. The sorter, as generally illustrated, is of the moving tray type more specifically disclosed in my prior U.S. Pat. No. 4,911,424 or it may be of the type disclosed in my prior U.S. Pat. No. 4,343,463. In any event, the apparatus for stapling the sets of sheets is adapted to cooperate in combination with sorters of the type disclosed in said patents, wherein a plurality of sheet receiving trays 1 are disposed in a vertically spaced stack with ends proximate to the sheet transport from the copier adapted to be vertically spaced apart to receive a sheet from the copier, at a sheet entry location as indicated by the arrow, and to rest one on the other at positions above and below the sheet entry location so as to occupy a minimum of space. The ends of the trays proximate the sheet entry location are vertically shifted in opposite directions by suitable cams, such as the spiral cams disclosed in my aforesaid patents or other suitable cams such as the "Geneva" cams of the DuBois and Hamma patent, U.S. Pat. No. 4,328,963, issued May 11, 1982. In the case of each of the sorters referred to above the outer end of the trays 1 are supported to allow swinging or pivotal movement of the trays under the influence of the tray shifting means or cams. As is well known in the art, the trays are adapted to be sequentially pivoted between the positions above and below the sheet entry location by drive means for the cams which are timed to the operation of the copier to move a tray in one direction or the other as copies are fed from the copier in a selected number, the motion of the trays being reversed following feeding of a selected number of sheets into the trays until collated sets of sheets are disposed in the individual trays.

In the operation of the present invention, in one form illustrated herein as seen in FIGS. 4–10, a stapler assembly 10 and a gripper assembly 11 are supported on a horizontally extended support structure 12 adjacent to the ends of the tray 1 proximate to the sheet exit transport rolls T from the copier. Also supported by the support structure 12 is a sheet infeed 13 including rolls 14 adapted to be suitably driven to pick up a sheet exiting the copier and transport the sheet to one of the trays 1 during sheet sorting operations.

The sorter includes a pair of suitable cams 2 at opposite sides of a frame structure 15 adapted to be driven by shafts 16 in opposite directions to engage cam followers 17 at opposite sides of the trays, so as to move the ends 18 of the trays vertically upon operation of the cams to space the ends 18 apart for ease of reception of the sheets. At locations above and below the cams, the tray ends 18 nest or rest on one another and are closely spaced so that a minimum of space is occupied. A better understanding of the sorter structure and operation may be obtained by reference to my prior patents referred to above.

During sorting operations, wherein copy sheets are being supplied to the trays, the infeed rolls 14 are horizontally substantially aligned with the increased space between trays above and below the cams, so that the sheets are positively fed into the trays, which as shown are upwardly inclined from the ends 18 in the direction of sheet feed.

When the collated sets of sheets are to be stapled, in accordance with the invention, it is necessary that the stapler means 10 and gripper means 11 be located at the increased space between the ends 18 of the trays. Accordingly, in the form of the invention shown in FIGS. 1–10, the support 12 for the stapler and gripper is mounted on means for vertically moving the support 12, and, therefore, the stapler and gripper, between the inoperative position of FIG. 2, at which the infeed rolls 14 are aligned with the space between the trays during sorting operations, and the alternate or operative position, as seen in FIG. 3, at which the sets of sheets are to be stapled. The means for vertically moving the support 12, in the illustrative embodiment, includes a pair of screw shafts 19 at opposite sides of the assembly engaged in opposite ends of the support 12. The screw shafts are adapted to be driven by a motor 20, and suitable drive means, not shown, for reversible rotation to vertically shift the support 12 between the positions referred to above.

It will be seen that the stapling means comprises a stapler base or anvil 21 which is adapted to be disposed beneath a set of sheets and a stapler body 22 which carries staples to be inserted into the set of sheets against the anvil. An electric motor M drives the stapler, on command. The details of the stapler are not germane herein, and various models of motor and solenoid operated staplers are available.

The gripping means 11 is adapted to engage a set of sheets in a tray, partially remove the set from the tray and move it to the throat 23 of the stapler, at which point the stapler is actuated to staple the set. More particularly, as shown, the gripping means includes a frame 24 mounted on the support structure 12 to move vertically therewith. Horizontally shiftably supported by the frame 24, for example, in horizontal slots 25 is a slide 26 adapted to be shifted in the slots 25, say by a drive pinion 27 driven by a reversible motor A to move horizontally towards and away from the sorter trays under the control of limit switches **27*a* and 27*b*, so that the slide 26 may be moved towards and away from the trays. Supported by the slide 26 and extended outwardly towards the tray ends 18 is a pair of griper arms 28 and 29. Arm 28 is fixed on slide 26 while arm 29 is pivoted to provide a clamping action at the outer ends 28*a* and 29*a* of the gripper arms. A solenoid C is adapted, on command, to effect movement of the grippers 28 and 29 together. Rubber-like grip elements 28*b* and 29*b* are provided on the outer, normally spaced ends of arms 28 and 29 defining a triangular relationship for effective gripping of the sheet sets without applying a deforming force. Preferably the solenoid armature 40 extends through the gripper arm 29 and a compression spacing 41 resiliently urges gripper members 29 about pivot 29*c* towards gripper member 28*b*** to limit the gripping force and avoid crumpling of the paper.

Since, as will be understood, the tray ends 18 support the overburden of the paper in the trays it is desirable that the ends 18 be sufficiently strong as to not yield under weight of paper. To grip a set in the trays for partial removal, the trays may have their inner ends 18 provided with openings, but it is preferred that the inner tray ends not be structurally degraded. Therefore, preferably, there is a tray liner **18*a* of resilient material nesting on the tray ends 18. The tray liner, like the tray end 18 has a flange 18*b* forming a lower registration edge for sheets in the sloping trays, and a lip 18*c* is provided on the liner so as to be engaged by means 29 to lift the liner from the tray end 18** to a position whereby the set of sheets resting on the liner may be gripped by the gripping means.

Figure 5:
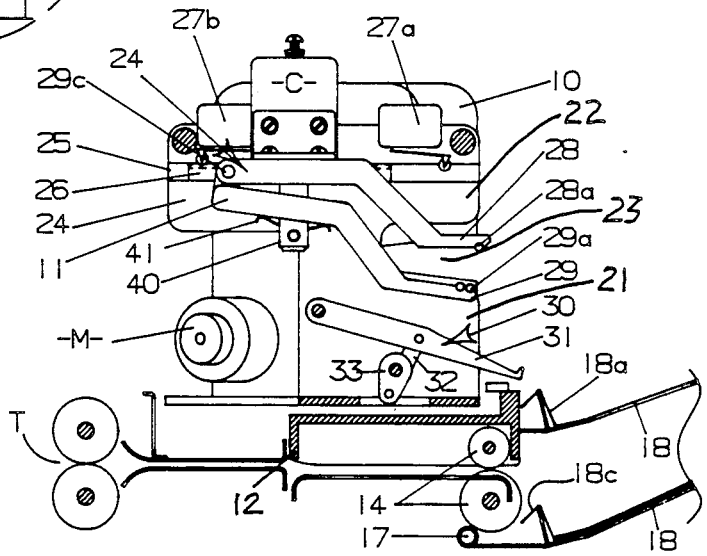
FIG. 5 is vertical section on the line 5—5 of FIG. 4.
Figure 6:
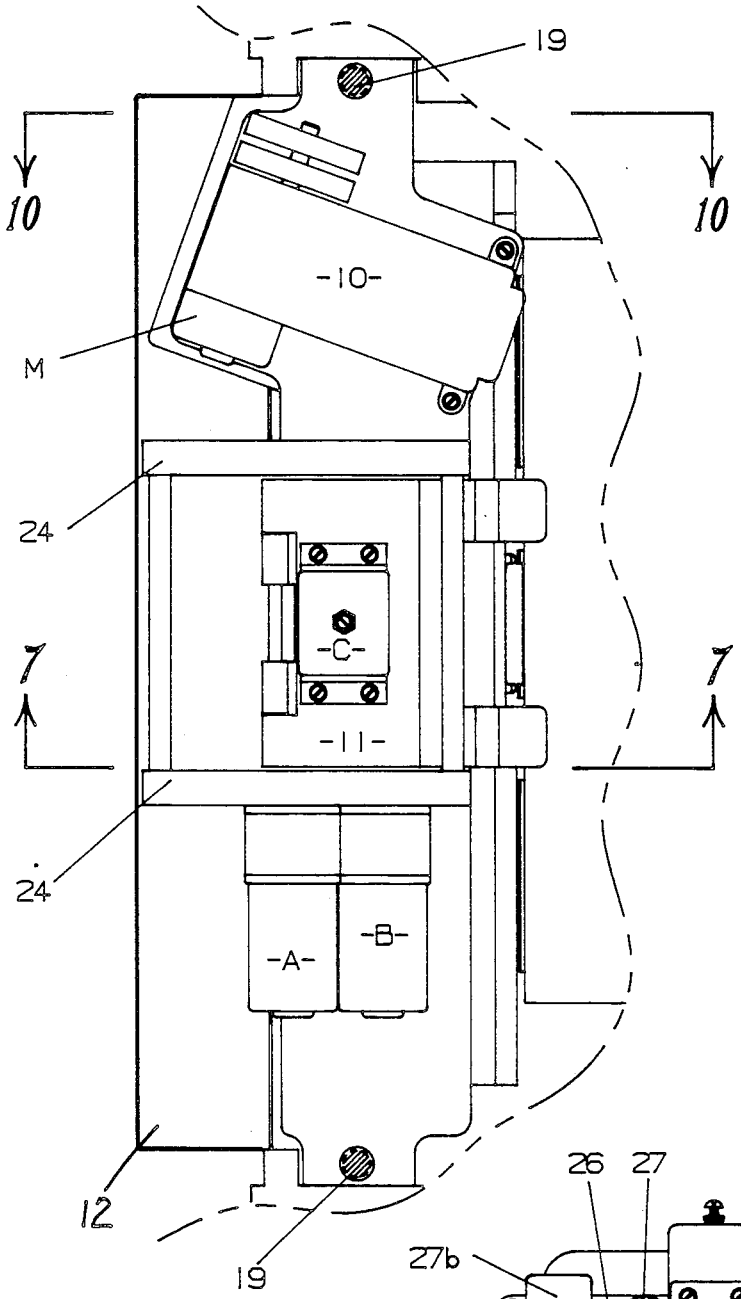
FIG. 6 is a fragmentary plan view as taken on the line 6—6 of FIG. 3.
Figure 7:
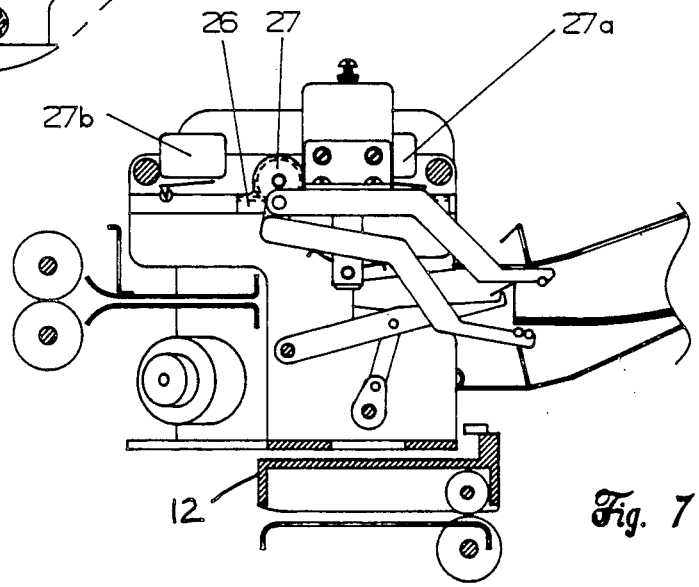
FIG. 7 is a vertical section on the line 7—7 of FIG. 6.
Figure 8:
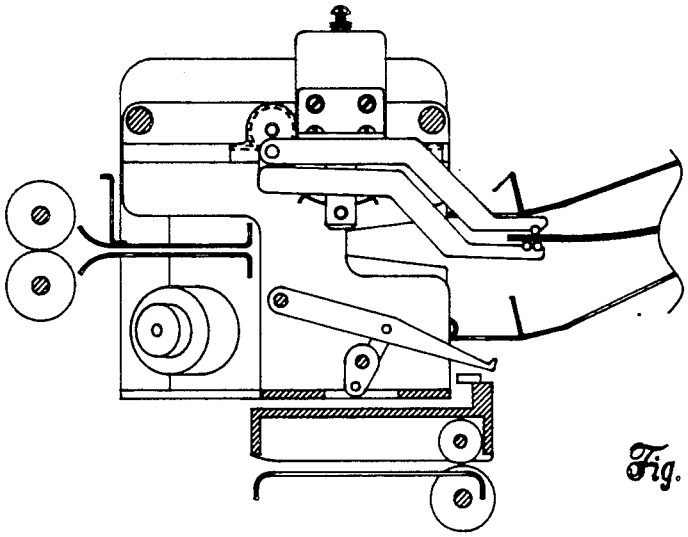
FIG. 8 is a view corresponding to FIG. 7 but showing the clamping means engaged with a set of sheets.
Figure 9:
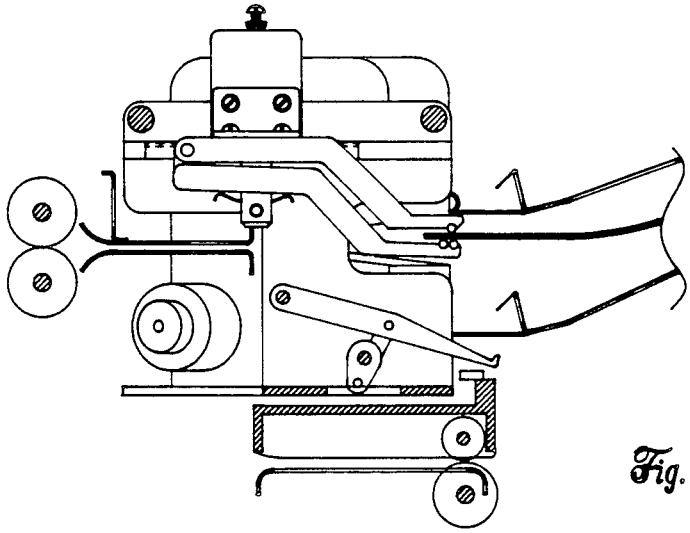
FIG. 9 is a view corresponding to FIG. 8 showing a set of sheets partially removed from a tray and in the stapling position.
Figure 10:
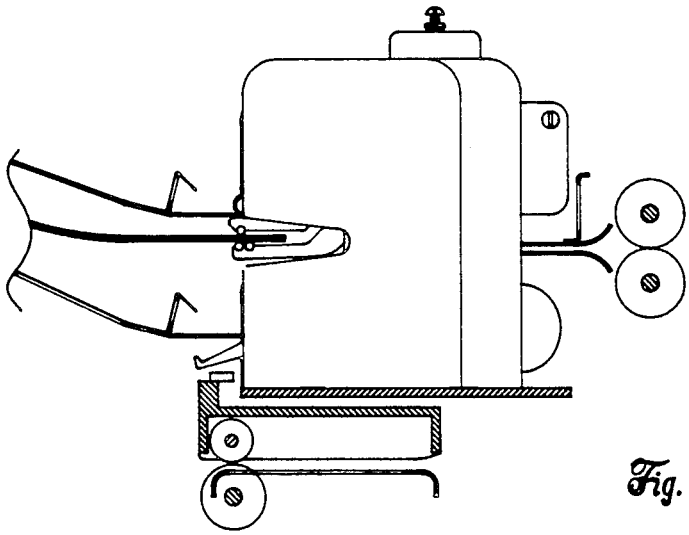
FIG. 10 is a vertical section as taken on the line 10—10 of FIG. 6.

The means 30 for lifting the tray liners comprises a lever 31, pivoted on frame 24, a link 32 connected to the lever 31 and to crank 33 connected to the link 32 and operable by motor B to pivot the lever 31 between the position of FIG. 5 and the position of FIG. 7 to engage the liner at **18*b* lifting the same from the end 18 of the tray and positioning the related end of a set of sheets for gripping by the gripping means. The liner 18*a* and the flange 18*b* are notched at 18*d*** to provide access for the gripping members, but the loss of beam strength is not material at that point.

In the sorting of sets of sheets, as will be understood from the foregoing, the trays are sequentially shifted in opposite directions to provide a large sheet access space. The sheet infeed rolls 14 are adapted to carry the sheets into the trays. Following the sorting operations, when it is desired to staple the collated sets, the support 12 is moved vertically so as to be horizontally aligned with the trays in the region of the arms where the trays are spaced apart. At this location of the gripping and stapling means, the actuating means for the trays are operated to successively vertically move the trays to the stapling position.

As each tray is presented to the stapling position, the sequence of operation is as follows:

1. Motor "B" lifts tray liner;
2. Motor "A" moves paper clamp forward;
3. Solenoid "C" closes clamp;
4. Motor "B" lowers tray liner;
5. Motor "A" moves paper clamp to Stapler;
6. Stapler operates (has own trip switch);
7. Motor "A" moves paper clamp forward;
8. Motor "B" lifts tray liner;
9. Solenoid releases paper clamp;
10. Motor "A" returns paper clamp (to home)
11. Motor "B" lowers tray liner (to home);
12. Bins shift.

In alternative modes of practicing the invention, the gripping and stapling means may be mounted in the frame at a vertically fixed location, and the tray shifting means may be vertically adjusted or otherwise constructed to cause relative positioning of the gripping and stapling means such that the gripping means has access to the space between trays at the sheet entry spacing or other appropriate spacing, so as to partially remove the set of sheets from successive trays and move the same into the stapler throat and return the stapled sets to the respective trays.

Referring to FIG. 11 a modified form of the invention is illustrated wherein on the drive shaft 16 which drives the tray shifting cam 2, an additional cam 102 is mounted so that the cams 2 and 102 rotate in unison to provide in addition to the enlarged sheet receiving space between trays as provided by cam 2, a space 102*a* is provided by cam 102 to enable operation of the set gripping and stapling means in the same manner as described above. Since the stapling and gripping means in this embodiment need not be vertically shifted it would be appreciated that the support 12 on which the stapler 10 and the gripping means 11 are supported may be stationary. However, in the stapling operation the same process occurs, i.e., the gripping means will be operated to engage and partially retract from a tray the collated set of sheets and move the set to the stapler and return the set to the same tray following stapling.

Referring now to FIGS. 12*a* and 12*b*, a still further modification is illustrated which enables the support 12 for the stapler 10 and gripping means 11 to be mounted in a fixed position with the infeed 13 aligned with the transport T from the copier during the sorting operations as the trays are successively moved up and down by the cam 2.

In this case, the cam 2 is supported in a cage 103 for vertical movement. The cam is disposed in a yoke 103*a* which is vertically shiftable. The yoke 103*a* is normally retained in the position shown in FIG. 12*a* with the cam 2 operative to shift the trays in the usual manner, by means of the armature 104 of a solenoid 105 which normally overlies the yoke 103*a* to hold it in the sorting position. Upon energization of the solenoid 105 the armature is temporarily retracted thereby allowing upward movement of yoke 103 to the position shown in FIG. 12*b*, and the solenoid armature 104 will then retain the yoke 103*a* in the upper position during stapling operations as the trays are activated by cam 2 to provide a space for partial removal of the collated sets from the trays by gripping means and the return of the sets following stapling.

Following completion of the stapling operations, retraction of the solenoid armature 104 will permit the yoke 103 to move downwardly in cage 103 to the sorting position of FIG. 121. It will be understood that the vertical positioning of the cam on the drive shaft 16 in the two operative positions is accomplished by rotation of the drive shaft 16 in one direction or the other, while the solenoid armature 104 is retracted, whereby the rotation of the cam causes it to move upwardly or downwardly as the inner ends 18 of the trays are separated by reason of the fact that the cam is not constrained from sliding vertically on the shaft 16 when the solenoid armature 104 is retracted. Such vertical movement of the cams caused by its movement from tray to tray is more particularly disclosed in the prior U.S. Pat. No. 4,478,406, granted Oct. 23, 1984, to DuBois.

While various embodiments of the invention have been shown and described herein, it will be recognized that the unique mode of operation in each form involves the partial removal of a collated set of sheets from the trays as they are successively moved past the gripping and stapling positions, the transfer of the collated set to the throat of the stapler and the return of the stapled set to the tray from which it has been partially removed.

While in the illustrative embodiments, the sets will be stapled in one location only, it will be understood that the structures supporting the stapler in a fixed position relative to the gripping mechanism may be modified in such a way that the stapler is horizontally translatable to a selective number of positions to effect stapling or "stitching" of the sets in a plurality of locations along one edge.

I claim:

1. A sheet collating and stapling machine comprising: a sorter having a plurality of trays arranged in a vertical stack to receive sheets fed from a source machine at an inlet location, means for sequentially shifting said trays at their ends adjacent to said inlet location between positions at which the trays are close together and positions at which a pair of adjacent trays are spaced further apart to receive sheets at said inlet location, sheet infeed means for feeding sheets into the space between said pair of trays to form said sets of sheets, stapling means located adjacent the space between said pair of adjacent trays adapted to receive a portion of a set of sheets and apply a staple thereto, gripping means operable to engage a set of sheets between said pair of adjacent trays and partially move said set of sheets in the opposite direction from the direction of infeed of said sheets and from between said pair of adjacent trays to said stapling means and returning the stapled set of sheets to the space between said adjacent pair of trays and releasing said set of sheets, supporting means for said stapling means said sheet infeed means and said gripping means mounted for vertical movement relative to said pair of adjacent trays to a first position at which said stapling means and said gripping means are located at the space between said adjacent pair of trays and a second position at which said infeed means is located at the space between said adjacent pair of trays, and means for vertically moving said supporting means between said position.

2. A sheet sorting machine as defined in claim 1, wherein said gripping means includes a horizontally movable support, gripping arms on said support and extending towards said trays, means for moving said support in opposite directions to a first position at which a set of sheets is disposed between said gripping arms, means for closing said arms to grip said set of sheets therebetween, and means to cause said support to be moved to a second position placing said set of sheets in position for stapling by said stapling means and returning said support to said first position following operation of said stapling means and then releasing said arms from said set of sheets in said first position.

3. A sheet sorting machine as defined in claim 1, including a liner in each tray, and lifting means operable to lift said liner in the enlarged space between the pair of adjacent trays into which said gripper arms are movable to a position for engagement of the set of sheets on said liner by said gripper arms.

4. A sheet collating and stapling machine comprising: a sorter having a plurality of trays arranged in a vertical stack, means for sequentially shifting said trays at one end between positions at which the trays are close together and positions at which a pair of adjacent trays are spaced further apart, stapling means located adjacent the space between said pair of adjacent trays adapted to receive a portion of a set of sheets and apply a staple thereto, gripping means operable to engage a set of sheets between said pair of adjacent trays and partially move said set of sheets from between said pair of adjacent trays to said stapling means and returning the stapled set of sheets to the space between said adjacent pair of trays and releasing said set of sheets, and sheet infeed means for feeding sheets into said trays to form said sets of sheets, including supporting means for said stapling means said gripping means and said infeed means mounted for vertical movement relative to said pair of adjacent trays, means for moving said supporting means to a first position at which said stapling means and said gripping means are located at the space between said adjacent pair of trays and a second position at which said infeed means is located at the space between said adjacent pair of trays, and means for vertically moving said supporting means between said first and second positions.

5. A sheet collating and stapling machine comprising: a sorter having a plurality of trays arranged in a vertical stack, cam means for sequentially shifting said trays at one end between positions at which the trays are close together and positions at which first and second pairs of adjacent trays are spaced further apart, stapling means located adjacent the space between said first pair of adjacent trays adapted to receive a portion of a set of sheets and apply a staple thereto, gripping means operable to engage a set of sheets between said first pair of adjacent trays and partially move said set of sheets from between said first pair of adjacent trays to said stapling means and returning the stapled set of sheets to the space between said first pair of adjacent trays and releasing said set of sheets, and sheet infeed means for feeding sheets into said second pair of adjacent trays to form said sets of sheets, said cam means including a first cam for forming said space between said first pair of adjacent trays and a second cam for forming said space between said second pair of adjacent trays, a shaft supporting said first and second cams for rotation together, said stapling means and said gripping means being operatively positioned at the space between the first pair of adjacent trays and said infeed means being operatively positioned at the space between said second pair of adjacent trays.

6. A sheet collating and stapling machine comprising: a sorter having a plurality of trays arranged in a vertical stack, means for sequentially shifting said trays at one end between positions at which the trays are close together and positions at which first and second pairs of adjacent trays are spaced further apart to form an enlarged space, stapling means located adjacent the space between said first pair of adjacent trays adapted to receive a portion of a set of sheets and apply a staple thereto, gripping means operable to engage a set of sheets between said first pair of adjacent trays and partially move said set of sheets from between said first pair of adjacent trays to said stapling means and returning the stapled set of sheets to the space between said first pair of adjacent trays and releasing said set of sheets, and means for feeding sheets into said trays to form said sets of sheets, said cam means, including a rotary cam engaged with the ends of said trays and operable upon rotation to be moved from tray to tray by engagement with said trays between a first position forming said enlarged space between said first pair of adjacent trays and a second vertically displaced position forming said enlarged space between said second pair of adjacent trays, said stapling means and said gripping means being located at one of said enlarged spaces between one pair of adjacent trays and said infeed means being located at the other of said enlarged spaces between the other pair of adjacent trays, means for rotating said cam in opposite directions, means for selectively and releasably holding said cam in the respective first and second position during operation of said gripping means and said stapling means and said infeed means, respectively.

7. A sheet collating and stapling machine comprising: a sorter having a plurality of trays arranged in a vertical stack, cam means for sequentially shifting said trays at one end between positions at which the trays are close together and positions at which said cam means space the trays further apart to form an enlarged space between certain of said trays at said one end of said trays, sheet infeed means for feeding sheets into such enlarged space in the direction of said one end of said trays, stapling means adjacent said one end of said trays, sheet set gripping means associated with said stapling means movable relative to said stapling means to grip a set of sheets in such enlarged space and retract the same in the opposite direction from the feeding of said sheets and move the set to said stapler and return the set to said trays, said stapling means and said gripping means being positioned relative to said infeed means for freedom of entry of sheets into the trays.

* * * * *